US007810815B2

(12) United States Patent
Connaway

(10) Patent No.: US 7,810,815 B2
(45) Date of Patent: Oct. 12, 2010

(54) BASEBALL GAME

(76) Inventor: Casey Connaway, 1100 Enzos Way, Windsor, CA (US) 95492

( * ) Notice: Subject to any disclaimer, the term of this patent is extended or adjusted under 35 U.S.C. 154(b) by 0 days.

(21) Appl. No.: 12/136,944

(22) Filed: Jun. 11, 2008

(65) Prior Publication Data

US 2009/0039602 A1 Feb. 12, 2009

Related U.S. Application Data

(60) Provisional application No. 60/943,186, filed on Jun. 11, 2007.

(51) Int. Cl.
*A63F 1/00* (2006.01)

(52) U.S. Cl. ..... 273/298; 273/244.2

(58) Field of Classification Search ..... 273/298, 273/244.2
See application file for complete search history.

(56) References Cited

U.S. PATENT DOCUMENTS

| | | | | |
|---|---|---|---|---|
| 4,822,043 | A * | 4/1989 | Carter | 273/298 |
| 5,071,136 | A * | 12/1991 | Lott | 273/259 |
| 5,145,173 | A * | 9/1992 | Crowder | 273/298 |
| 5,201,525 | A * | 4/1993 | Castro | 273/293 |
| 6,170,829 | B1 * | 1/2001 | Harvey | 273/298 |
| 6,626,434 | B2 * | 9/2003 | Tanaka | 273/292 |
| 2002/0020966 | A1 * | 2/2002 | Tanaka | 273/292 |

* cited by examiner

*Primary Examiner*—Benjamin H Layno
(74) *Attorney, Agent, or Firm*—Diehl Servilla LLC

(57) ABSTRACT

A new baseball player card is disclosed. A new baseball game is also disclosed. The baseball player cards have game playing indicia on the face of the card.

6 Claims, 14 Drawing Sheets

Baseball Card

Baseball Card

Baseball Card

Baseball Card

Baseball Card

Baseball Card

Baseball Card

Baseball Card

Albert Puller

*Albert had a standout year as St. Louis' first baseman. He hit 35 homers and drove in 125 runs, finishing in third place in MVP voting.*

1B: 11-24
2B: 25 - 34
3B: 35
HR: 36-46
K: --
W: 47-63
S/D: B/A

FIG. 12

Baseball Card

Baseball Card

Baseball Card

BASEBALL GAME

CROSS-REFERENCE TO RELATED APPLICATIONS

This application claims the benefit under 35 USC 119(e) of provisional application Ser. No. 60/943,186, filed Jun. 11, 2007, the contents of which is incorporated herein in its entirety.

BACKGROUND OF THE INVENTION

The present invention relates to baseball, including baseball cards and a baseball game.

Children feverishly buy baseball cards, but only for a short while. Typically, children are let down following the purchase of their cards and the purchases do not continue. People become disinterested in buying baseball cards for a number of reasons, but one of the main problems with traditional baseball cards is that are only good for collecting.

Thus, baseball cards would be improved if they offered something more that just being a collectible.

SUMMARY OF THE INVENTION

The Game will present a new reason to purchase baseball cards, for they will no longer just sit and collect. This game will have a dramatic and permanent effect on the world of baseball card collecting, just like the immensely popular games "Pokemon" and "Magic" did for their respective markets.

The Game has built-in longevity. First, baseball cards will finally have an actual value and purpose, and that improvement in the market will never reverse itself; there will be the days of card collecting before The Game, and the days of card collecting after The Game. Secondly, baseball will never go out of style. New generations only get bigger, and baseball gains new fans every year. Finally, because baseball rosters change each year, The Game will always need to be updated, giving it an eternal shelf life.

The Game will also be able to capitalize on the poker boom. The Game is very much like Texas Hold-Em for baseball cards. You and your opponent each have your own hand, or team, and the Playing Deck in the middle controls the action. Because The Game is played with the Playing Deck and not the rolling of a di (like "MLB Showdown"), there are only four of each card available in the deck (like poker). This creates a game where you know certain numbers are coming or already burned, rather than a random roll of the di for each outcome. This dramatically affects the fun of playing The Game. In contrast to video games, you cannot control the outcome, you can only guide and manage your team, which, like poker, leads to unbelievable excitement as the action is often out of your control.

The Game will give a depressed market a dynamic reason to be active, and active like never before. The Game will be how the world views baseball cards going forward. There will be no reason to buy cards that don't play, as those who buy The Game cards will be able to see the actual value and worth of the card before them, in addition to being able to actually play baseball with them. With The Game, fathers and sons will be able to play baseball in the backseat of a car on a long road trip; grandfathers and grandsons will be able to play baseball on the back porch of on a hot summer day; Major League ball-players will be able to play 'cards' in the clubhouse, or on a team flight; children all over the world can learn how to manage a team by buying and playing The Game. The Game is good for baseball, good for baseball cards, good for the consumer, and good for the producer. It is time to welcome the world to the new age of baseball card collecting. It is time for The Game.

DESCRIPTION OF THE DRAWINGS

FIGS. 11 to 14 illustrate player cards with game playing indicia in accordance with further aspects of the present invention.

DESCRIPTION

In accordance with one aspect of the present invention, you can play baseball with baseball cards.

Figure 1:
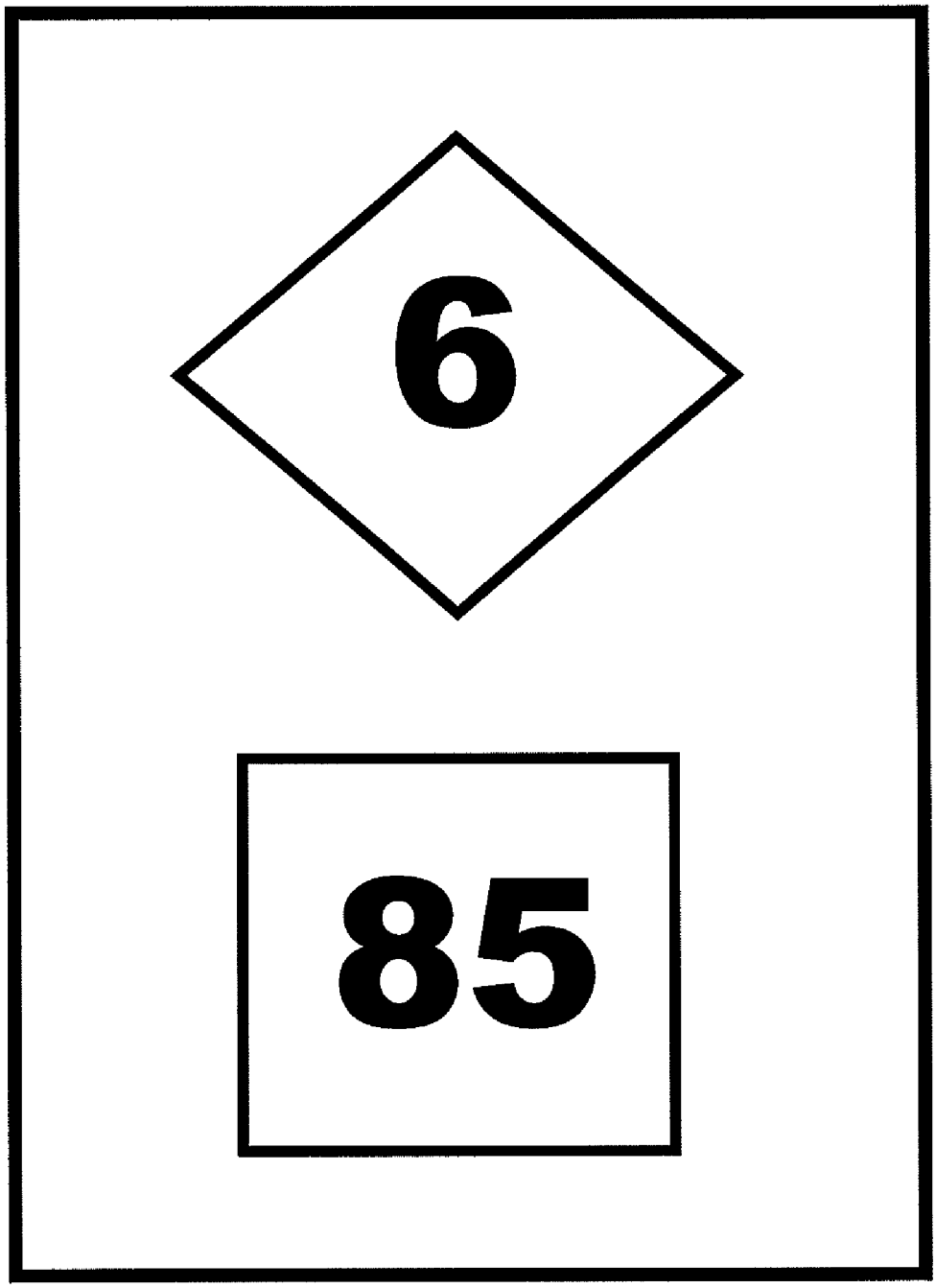
FIGS. 1 to 4 are illustrative examples of a cards in a playing deck in accordance with an aspect of the present invention.
Figure 2:
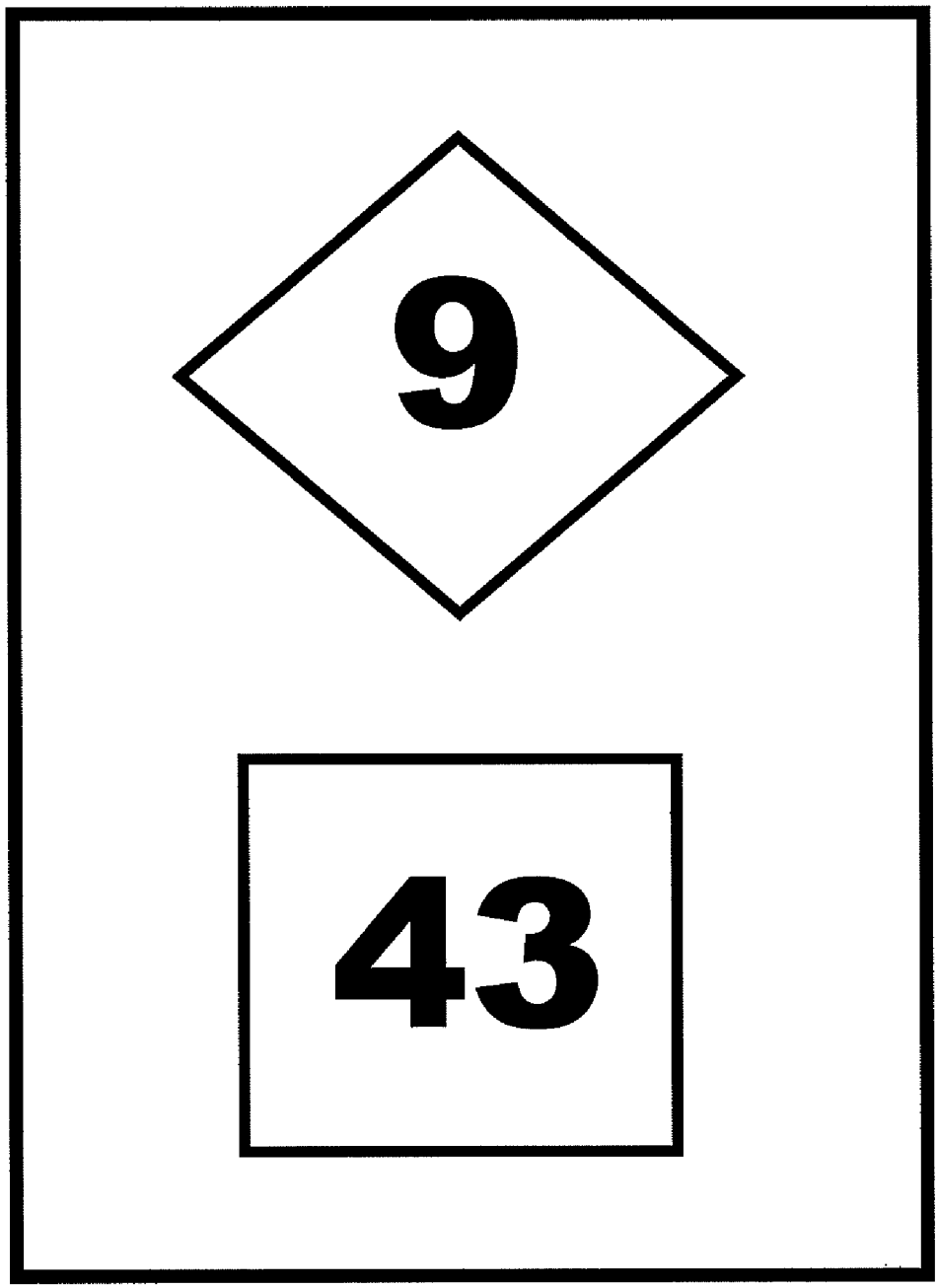
Figure 3:
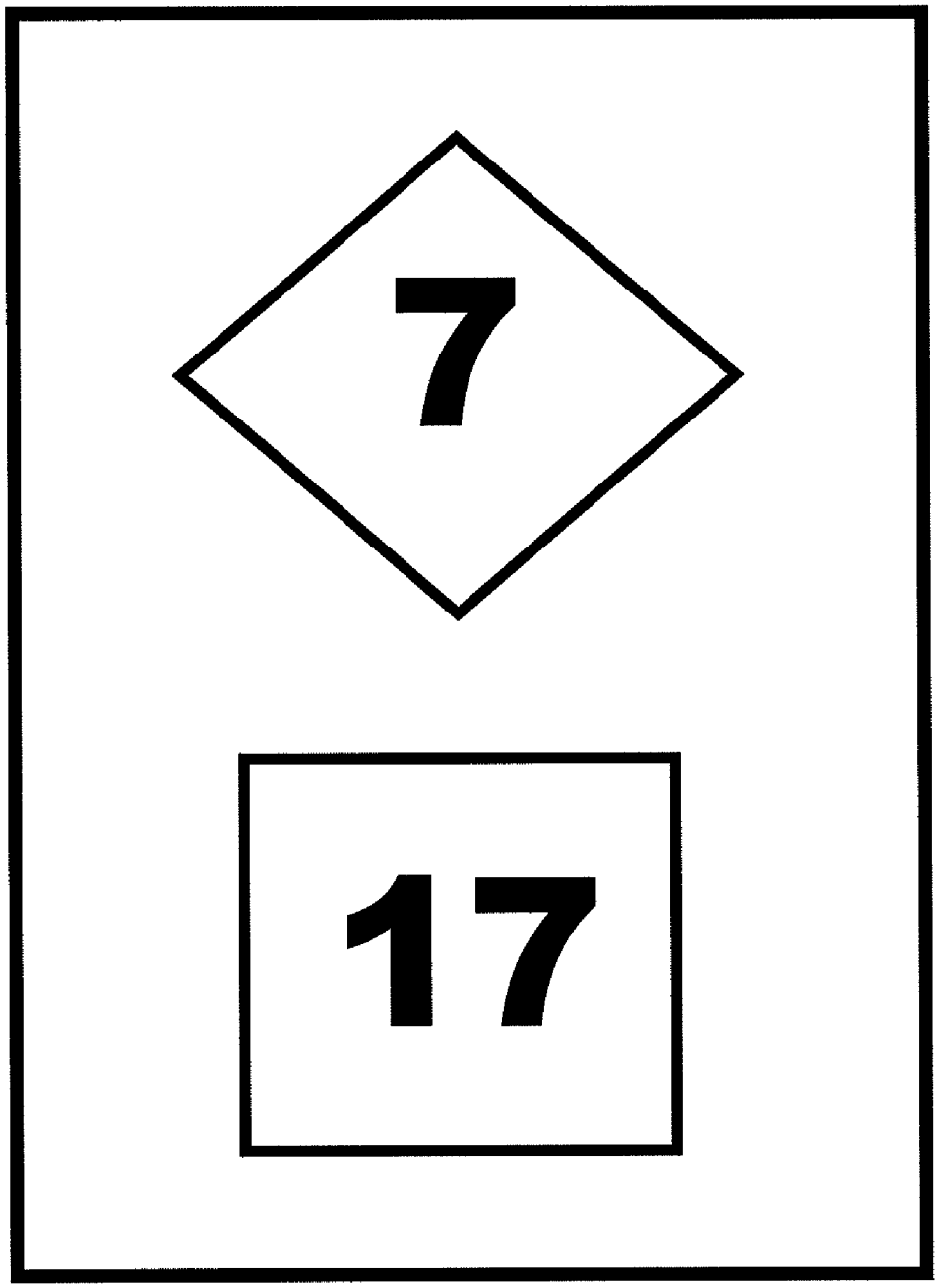
Figure 4:
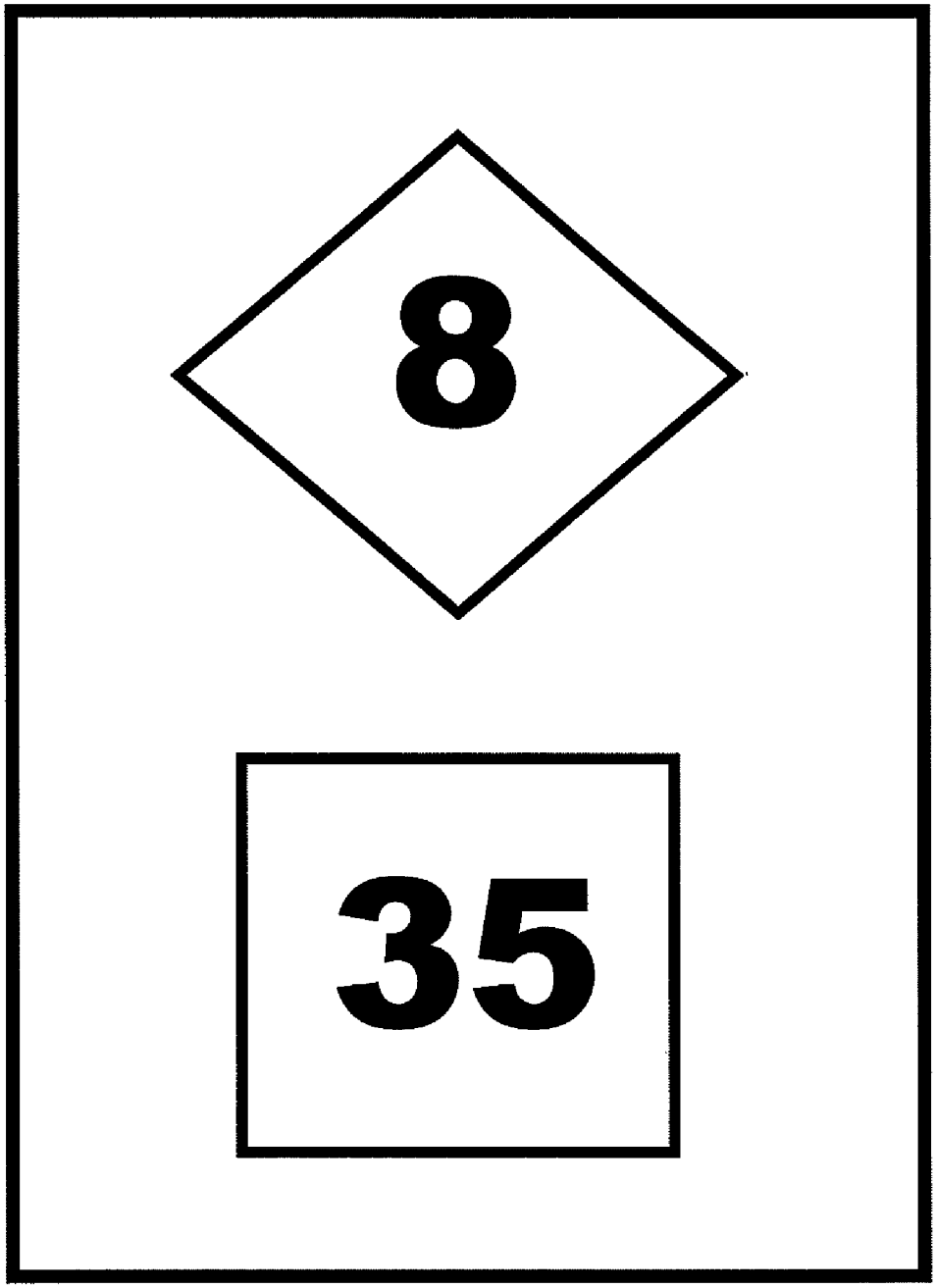

The following terms are used in this description:

PLAYING DECK: The playing deck preferably includes 256 half-sized cards each with a ◇ and; each combination represented once (6/11→9/88). Examples of the cards in the playing deck are shown in FIGS. 1 to 4.

INDICATOR (◇): number (6, 7, 8, 9) in the diamond on a card in the PLAYING DECK, on the 1st flip; determines which card to read for the outcome.

LOCATOR (◇): number (6, 7, 8, 9) in the diamond on a card in the PLAYING DECK, on the 2nd flip; determines where the outcome takes place.

OUTCOME ( ): number (11-88) in the square on a card in the PLAYING DECK, on the 2nd flip; determines the outcome of the play.

ROLL (R): used for advanced play. Roll dice once for a result. 'R10' (i.e.) means a roll of 10 or greater.

SPEED (S): speed is ranked A+, A, B, C.

DEFENSE (D): defense is ranked A+, A, B (any player out of position is ranked B).

THROWING (T): added (i.e. +2) to the roll of the dice; see advanced play rules.

PITCHER'S NUMBER: the pitcher's # is used on every first flip, determining where to apply the ensuing outcome. All regular starters are S-7; All ace starters are S-8; All regular relievers are R-7; All ace closers are R-8.

How to Start—

What you need: the Playing Deck, a team of The Game baseball cards, one 12-sided di.

Create your starting lineup, bullpen, and bench.

Shuffle the Playing Deck and prepare face down.

Have the starting pitcher's baseball card, and the first batter's baseball card, ready to read.

How to Play—

AN AT-BAT IS A SERIES OF TWO FLIPS OF THE PLAYING DECK.

The first flipped card determines whether the pitcher or the batter controls the pitch. The second flipped card determines the outcome and location of the play.

FLIP THE FIRST PLAYING DECK CARD—identify the ◇, it will be a 6, 7, 8, or 9.

Apply the ◇ to the pitcher's baseball card. If the ◇ is higher than the pitcher's number, the upcoming outcome is applied to the batter's card. If the ◇ is equal to or lower than the pitcher's number, the upcoming outcome is applied to the pitcher's card.

FLIP THE SECOND PLAYING DECK CARD—identify the, it will be 11-88. Apply the outcome to the appropriate card, either the pitcher or the batter.

Figure 5:
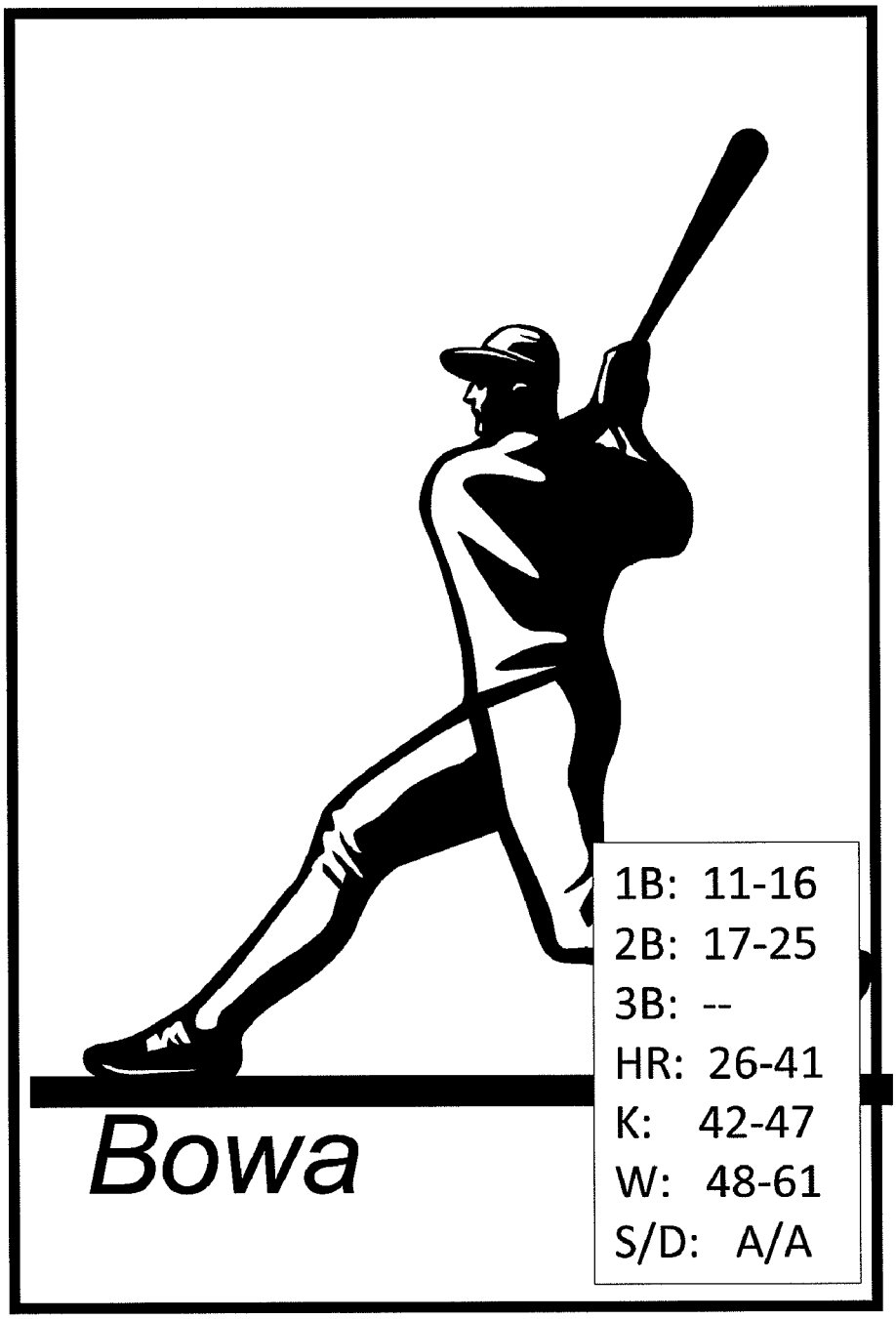
FIGS. 5 and 8 to 10 are illustrative examples of a first side of playing cards of field players with game playing indicia in accordance with an aspect of the present invention.
Figure 6:
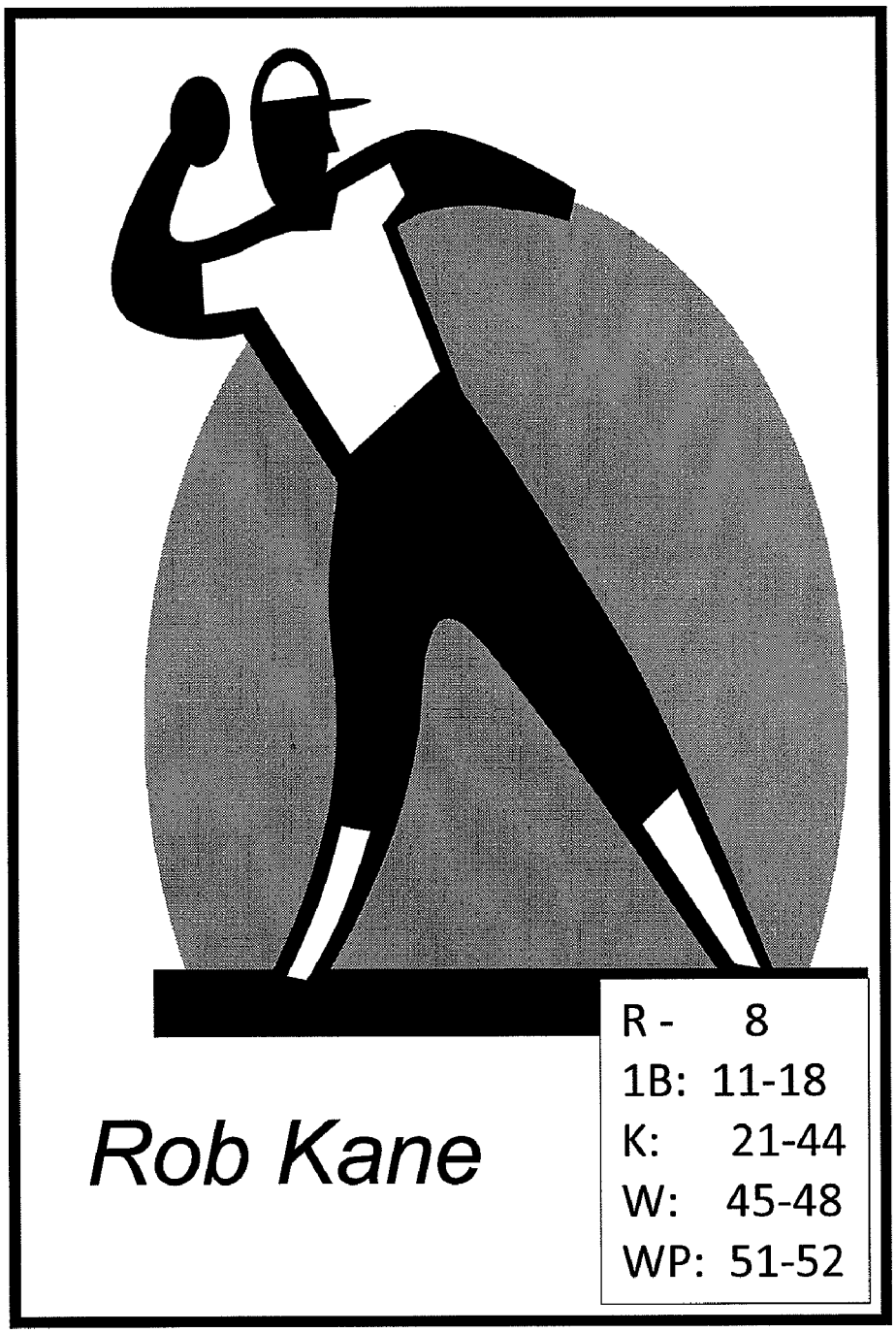
FIGS. 6 and 7 are illustrative examples of player cards of pitchers with game playing indicia in accordance with an aspect of the present invention.
Figure 7:
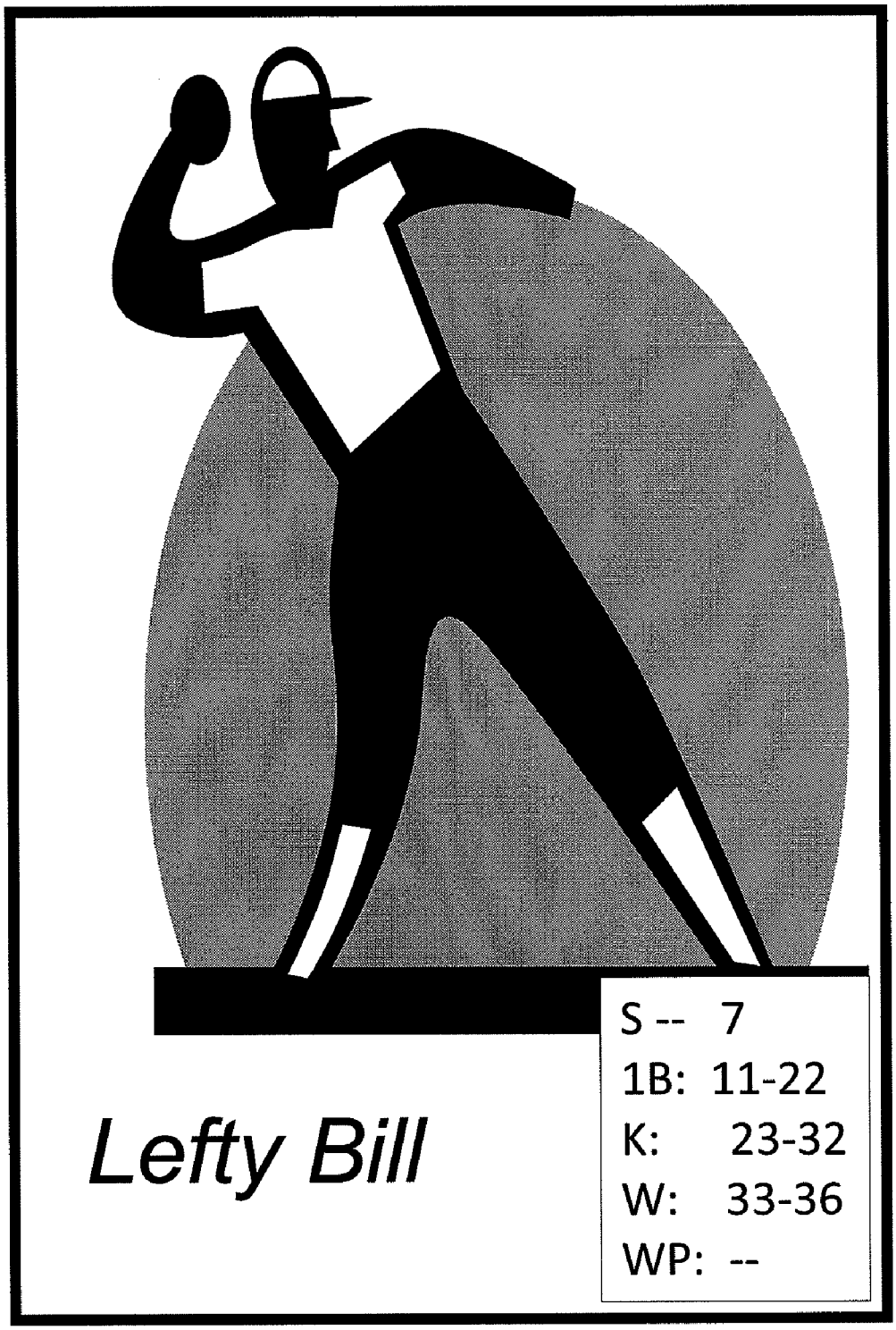
Figure 8:
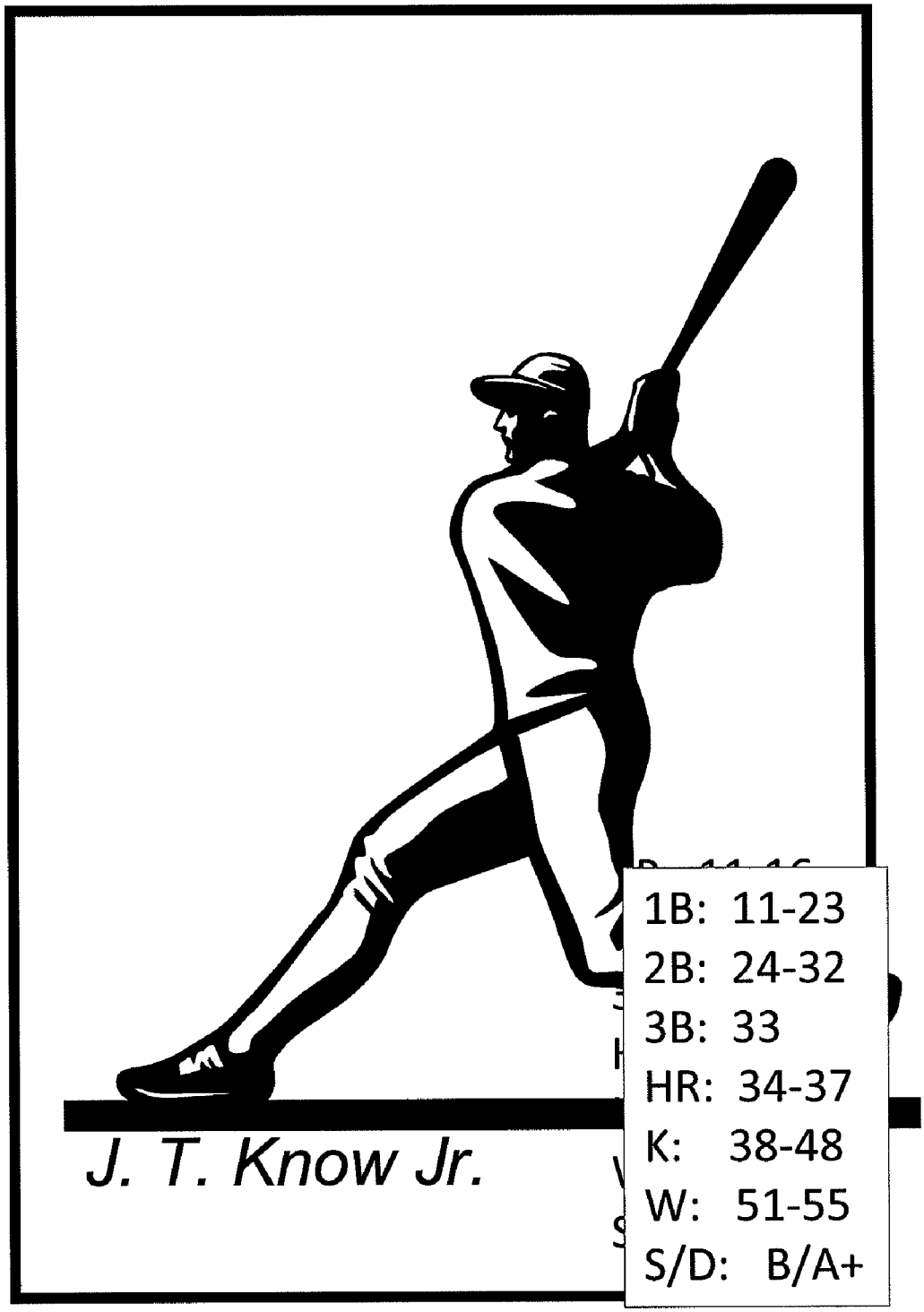
Figure 9:
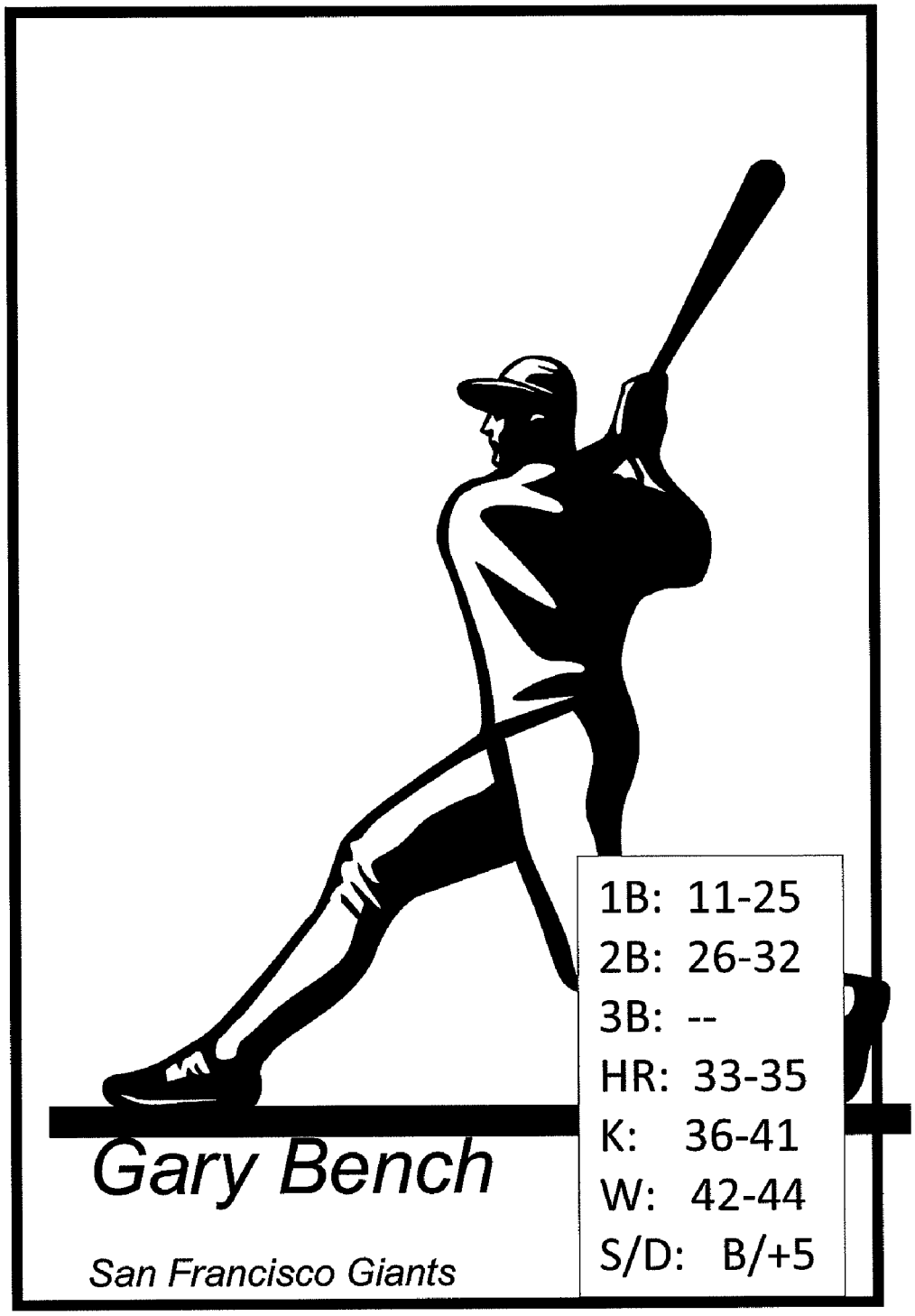
Figure 10:
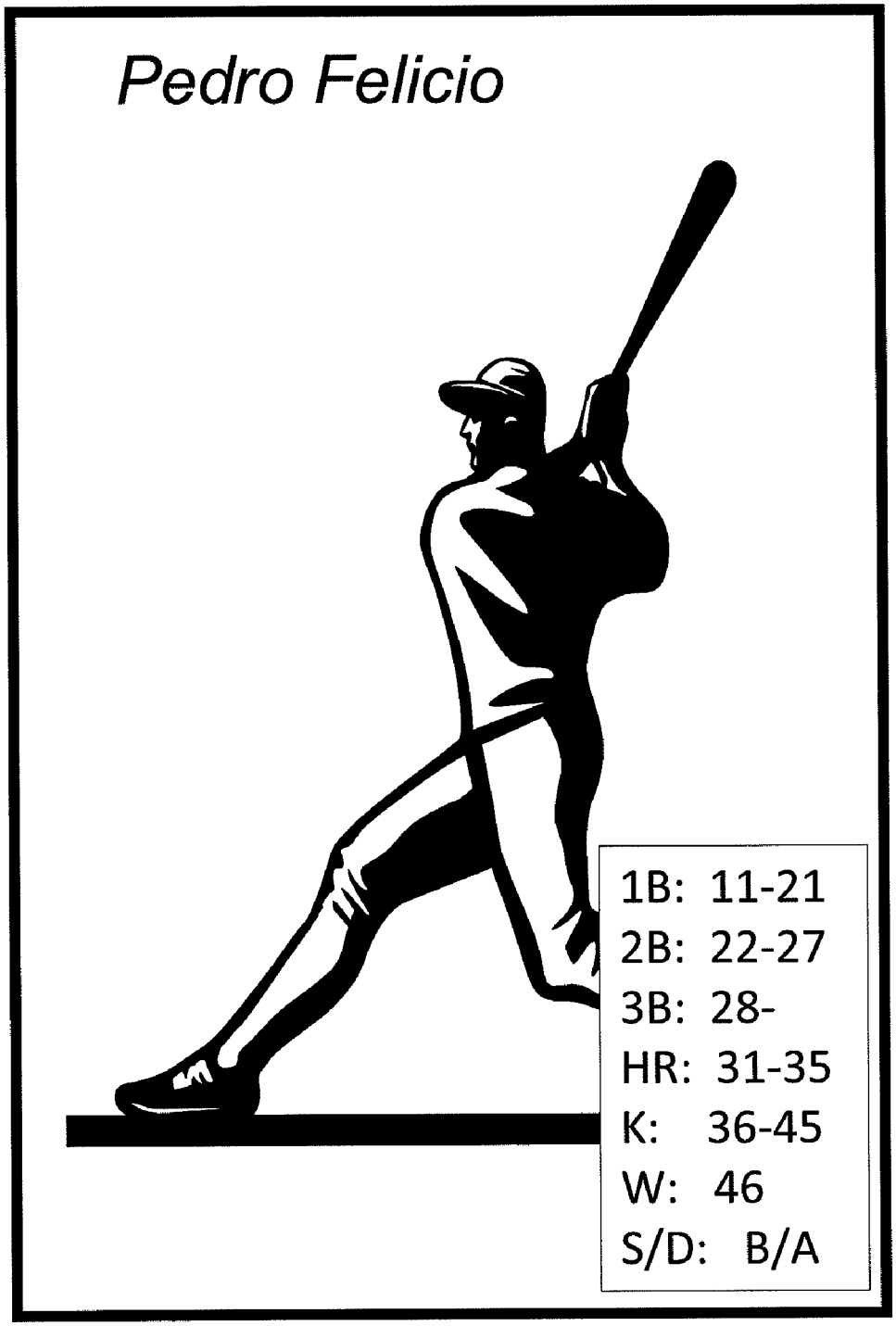
Figure 11:
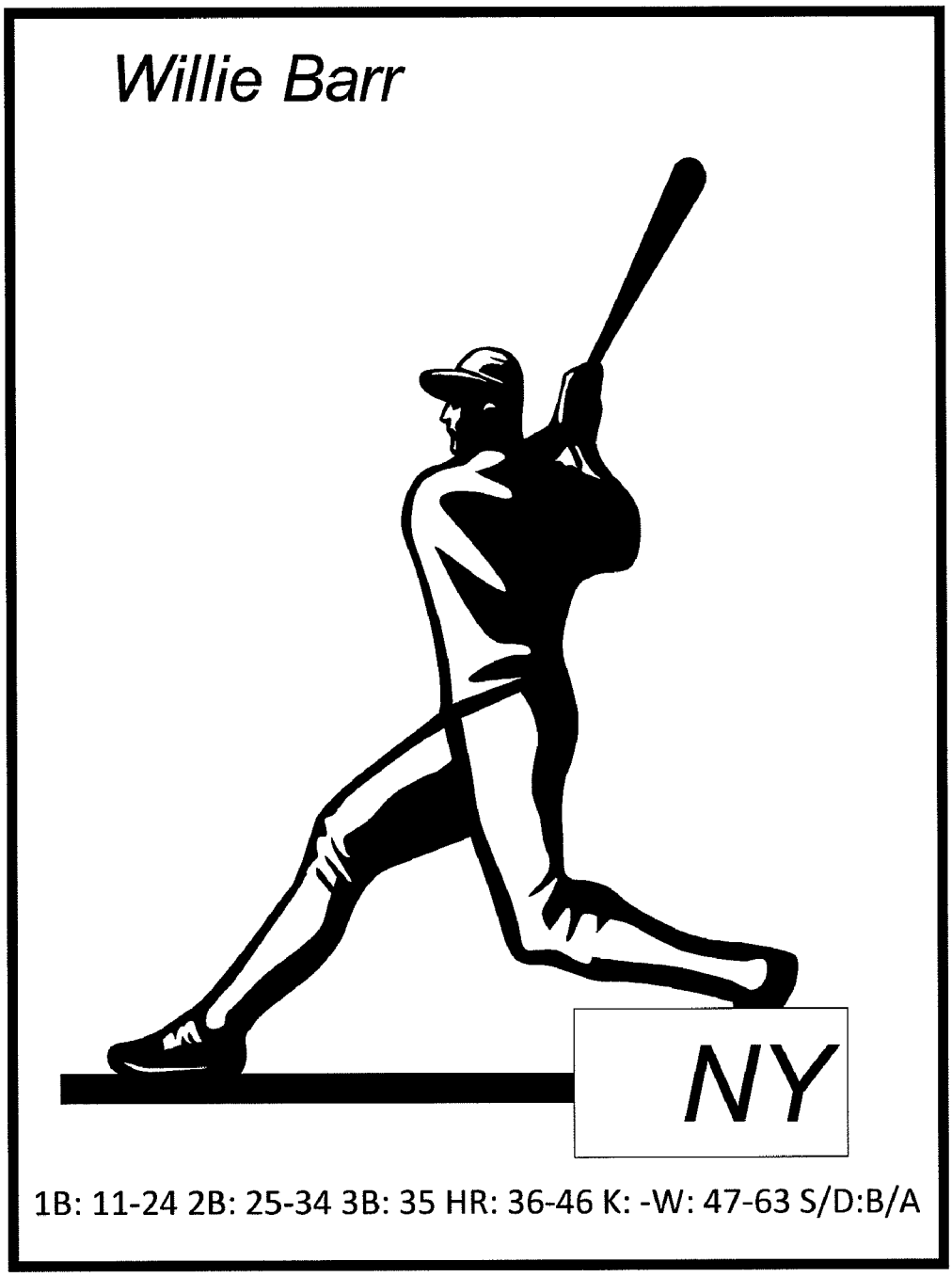
Figure 13:
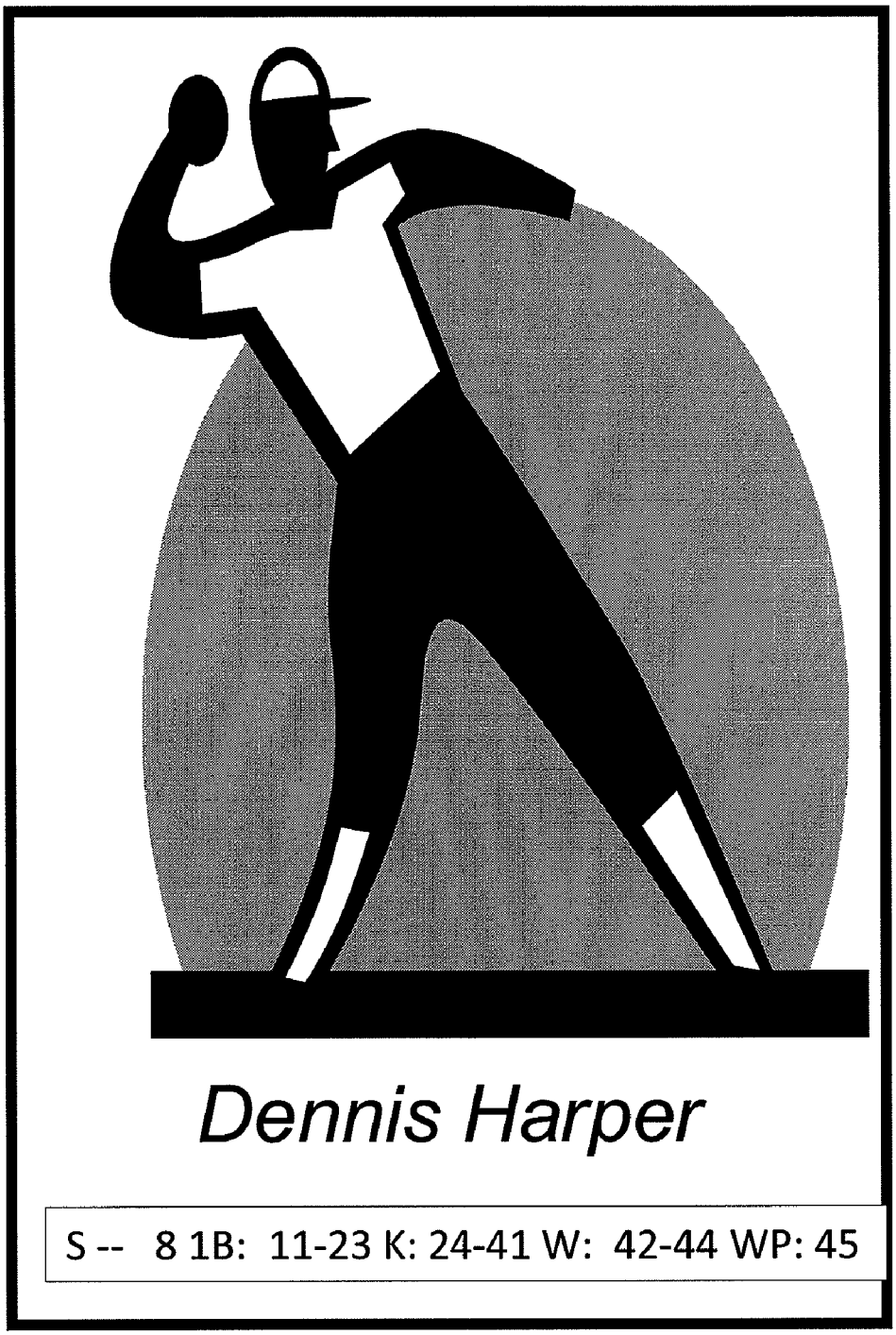
Figure 14:
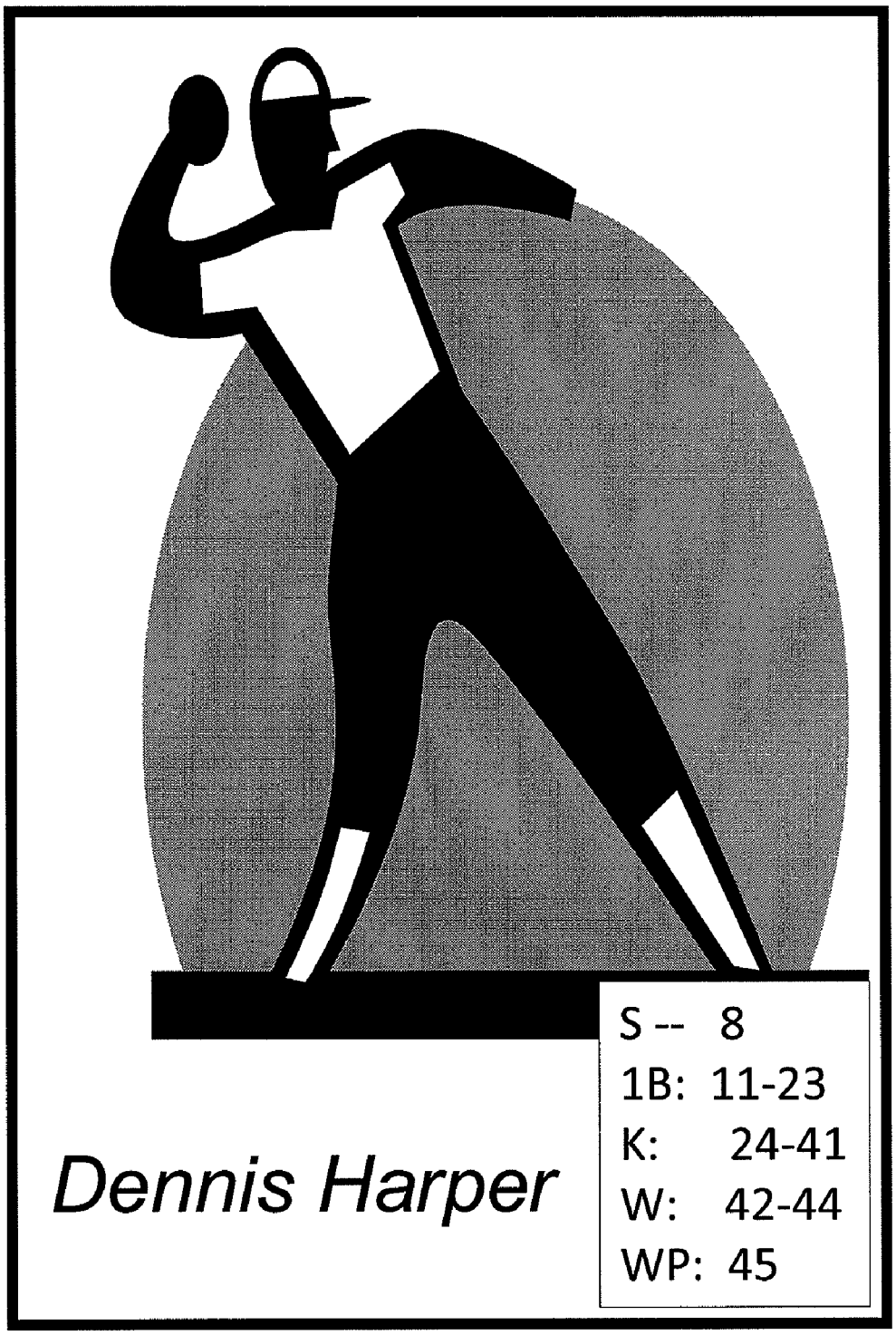

As illustrated in FIGS. 5 to 14, these numbers are found on the player cards. They can be located in a number of different places on the player cards.

If the outcome falls beyond the ranges on the applied card, the result is an out—use the chart for outs. If the outcome falls within the ranges on the applied card, the result is on the card—also use the chart for hits.

The ◇ on the second flip determines the location of the play. On the infield: ◇6=3B, 7=SS, 8=2B, 9=1B. In the outfield: ◇6=ball pulled, 7=LF, 8=CF, 9=RF.

So to play, we start with a team of baseball cards with The Game printed on them, an official Playing Deck of 256 cards, Rules of the Game, one 12-sided di and q scorecard.

As previously described, each of the Playing Deck cards has 2 numbers on it. The top number is the Indicator; housed in a ◇, one of four possible numbers, 6-9. The bottom number is the Outcome; housed in a, a base-9 number 11-88. (11-18, 21-28, 31-38, 41-48, 51-58, 61-68, 71-78, 81-88.) There are 64 possible numbers for the Outcome, and 4 possible numbers for the Indicator, making 256 total Playing Deck cards. This is an Official Playing Deck. The Indicator indicates two things during the course of play: First, it simulates the release of the pitch and determines who is controlling that pitch (the pitcher or the batter). On the second flip, it indicates the location of the Outcome of the play. The Outcome dictates the result of the play. The interaction between the Indicator and Outcome is what defines The Game.

As previously described and as shown in FIGS. 5 to 14, on each baseball card there is information that defines that player's potential. Below is the information on the cards of St. Louis stars Chris Carpenter (FIG. 14) and Albert Pujols (FIG. 12).

| | |
|---|---|
| S - 8 | 1B: 11-24 |
| 1B: 11-23 | 2B: 25-34 |
| K: 24-41 | 3B: 35 |
| W: 42-44 | HR: 36-46 |
| WP: 45 | K: — |
| W: 47-63 | |
| S/D: BA | |

On the cards, S-7 reveals that the pitcher is a starter (S), and that he is an ace (8). 1B (Single), K (Strikeout), W (Walk), and WP (Wild Pitch) are found on every pitcher card. 1B, 2B, 3B, HR, K, W, and S/D (speed & defense) are found on every batter card. The numbers following each category make up the range for that Outcome.

A Game Play Synopsis is: An at-bat is a sequence of two flips of the Playing Deck. Flip over the first card of the Playing Deck and read the Indicator to determine whether the controlling card is the pitcher's or the batter's. Flip over the next card of the Playing Deck and apply the Outcome to the ranges on the controlling card. Also, on the second flip, the Indicator tells you the location of the Outcome. For Outcomes in the infield: ◇6=3B; ◇7=SS; ◇8=2B; ◇9=1B. For Outcomes in the outfield: ◇6=ball pulled; ◇7=LF; ◇8=CF; ◇9=RF. If the Outcome falls within the ranges on the controlling baseball card, the result is evident; details can be learned from the chart for hits. If the Outcome is beyond the ranges on the controlling baseball card, the result is an out; details can be learned from the chart for outs.

Game Play Details: Both teams set their starting lineup, bench, and bullpen. Shuffle the Playing Deck and place face down. Flip over the first Playing Deck card and read the Indicator. This number tells you whether the pitcher's card or the batter's card is controlling the Outcome of the next flip of the Playing Deck. Indicators ◇6 & ◇7 are controlled by the pitcher. Indicators ◇8 & ◇9 are controlled by the batter. The exception is Indicator ◇8, which is controlled by dominant pitchers. This is the way that dominant pitchers, like Chris Carpenter (S-8), have the upper hand. Flip over the next Playing Deck card and read the Outcome, applying it to either the pitcher or the batter. The Outcome will either fall within the ranges on the controlling card, or it will fall beyond the card's ranges, resulting in an out (see chart for outs). In addition to revealing the Outcome of the play, the Indicator on the second flip reveals the location of the play.

Learning the Language: Outcomes are learned quickly as the language of The Game is very logical. It is likely that both the chart for hits and the chart for outs will be unnecessary by the end of the first game. The fundamental rule for Outcomes is that the bigger the number, the further the ball went. The charts for hits illustrates that, for example, the 24 is hit a bit harder and further than the 23 would be, yet not as hard or as far as the 25. The chart for outs illustrates that all off-the-card Outcomes are all outs, and are progressive; 41-58 are infield outs on the ground, 61-68 are infield outs in the air, 71-88 are outfield outs, with each larger number being a progressively harder hit ball.

The following examples are provided:

◇9/ 58 is a searing ground ball to 1B.

◇8/ 47 is an easy grounder to 2B.

◇7/ 61 is a low line drive to SS.

◇8/ 68 a pop fly to deep 2B.

◇7/ 71 the LF rushes in and dives to make the catch.

◇9/ 88 the RF has to climb the wall to make the catch.

This describes a preferred embodiment of the Game. Other embodiments are possible. It is now possible to PLAY BALL with player cards. Every two flips is an at-bat. All baseball rules and logic apply.

The following ADVANCED PLAY RULES can be used. A 12-sided dice should be used.

Pitching Rule #1

RH pitcher verses RH batter=strikeout on all 11 & 12 outcomes.

On a LH pitcher verses LH batter=strikeout on all 11 & 12 & 13 outcomes.

Ground Ball

Batter SpB and SpC doubled up on all 51-58, lead runner and batter both out.

Double Plays:

SpB and SpC batter doubled up on all 41-46 (◇7 & ◇8 only—pitcher fields).

SpA batters doubled up on all 53-58, and all 45-46 (◇7 & ◇8 only).

SpA+ batters doubled up on all 55-58.

Sacrifice Fly:

runner on third, 75-88 scores SpA+; 78-88 scores SpA runner; 82-88 scores spB.

Sacrifice Bunts:

R2-11 runner(s) advance one base, batter out.

R1 & R12 bad bunts, lead runner out, batter SpB, SpC out, double play; batter SpA safe.

Bunting for a Hit:

SpA+ can bunt for a base hit: R11-12 SpA+ batter safe, R1-12 runners advance.

Stealing

SpA+ thrown out R12, SpA out R10, SpB out R8.

Second Base:

Roll the dice, then add the catcher's arm.

Steals of third, additional +1 for the catcher's arm.

Hit & Run:

Announce before second flip—runner(s) move on the second flip.

Outfield Single: runner 1st to 3rd, and 2nd to Home; Double, all runner's score.

Ground ball outs, 41-58, are not double plays, batter out, runner(s) advance.

Line drive outs 61-64, 71-74, are double plays.

Pop ups and fly balls, 65-68, 75-88, runner(s) return.

Strikeout: rules the same as for stealing, catcher's arm an additional +1.

Runner

Without hit&run, SpA+ runner 1st to 3rd on singles 15-23 to center or right.

First to Third:

SpA on singles 15-18 to center or right; SpB on singles 15-16 to right only.

Scoring

SpA+, A score on all doubles with two outs. SpB on top four doubles, top 2 to left (2 outs).

From First:

SpA+ scores on doubles in top four of batter's doubles range (top 2 to left field).

SpA scores on doubles in top three of batter's doubles range (top 1 to left field).

SpB scores on top two doubles, one or none out, to center or right only.

Scoring from Second:

SpA+ runners can score on any outfield single.

SpA can score on any outfield single with two outs;

With one or none out, SpA scores on 15-23; SpB scores on 15-21; SpC scores on 15-18.

To left field, subtract two, SpA, 15-21, SpB, 15-17, SpC, 15-16

Scoring from Third:

Sacrifice fly; wild pitch; or any base hit;

Ground balls outs, 41-58, to first, second or short (◇9, ◇8, ◇L7) but not third (◇6).

Runner Second to Third:

SpA+ advance on 78-88 to right (◇L9), 81-88 to center (◇8), 84-88 to left (◇7).

SpA advance the same but 81, 82, and 85 as low numbers; SpB advance 83, 85, 87.

All runners advance 2nd to 3rd on ground ball outs, 51-58, to second (◇8), or first (◇9).

All runners advance 2nd to 3rd on all slow ground ball outs, 41-48, except to the pitcher.

Playing the Infield in:

Done if runner at third with less than two outs; must announce before the first flip.

Ground balls 56-58 are now singles.

Ground balls 41-55 runner stays, batter is out; no ground ball double plays.

Challenging the Defense:

Defenders DefA+ can not be challenged.

DefA infielder can be challenged on ground balls 58; DefB infielder on 57 and 58.

R11 beats DefA, R9 beats DefB; infielder does not make the play, batter has a single.

DefA outfielders can be challenged on 88; Def B outfielders on 87 and 88.

R9 beats DefB, R11 beats DefA; result is a double, SpA+ gets a triple, R12 triple SpA.

Stealing a Hit:

DefA+ infielder can steal single 14; R7 for SpA; R4 for SpB; R1 for SpC.

DefA+ outfielder can take the lowest double of range with a R12.

DefA+ can take away the lowest home run with a R12.

Throwing a Runner Out:

An outfielder with a 'good arm' can throw a runner out with a R12 on the following:

Lowest two of a sacrifice fly, or scoring on the highest two singles, for SpA or SpB:

SpA or SpB going first to third or first to home with less than two outs. (SpA+ safe)

An outfielder with a 'great arm' can challenge the same situations with a R10.

The following is a preferred CHART FOR HITS, as mentioned earlier.

| | | | |
|---|---|---|---|
| 11 - bloop single: | | or pitching rule #1. | |
| 12 - bloop single: | | or pitching rule #1. | |
| 13 - infield single: | | SpB out R11/SpC out R9. | |
| 14 - infield single: | | DefB lets through infield. | |
| 15 - ground ball singles: | | 15-18 are ground ball singles, | |
| 16 - | | or soft line drives, through the infield | |
| 17 - | | | |
| 18 - | | | |
| 21 - line drive base hits: | | 21 and above are line drive hits, | |
| 22 - | | singles off of a pitcher's card, and | |
| 23 - | p | singles building to extra base hits and | |
| 24 - | o | home runs, off of a batter's card. | |
| 25 - | w | | |
| 26 - | e | | |
| 27 - | r | | |
| 31 - | | | |
| 32 - | n | if this is batter card's highest hit #: | |
| 33 - | u | equal to BA. of: = | .237+ |
| 34 - | m | batting potential = | .246+ |
| 35 - | b | batting potential = | .254+ |
| 36 - | e | batting potential = | .263+ |
| 37 - | r | batting potential = | .271+ |
| 38 - | s | batting potential = | .280+ |
| 41 - | | batting potential = | .289+ |
| 42 - | | batting potential = | .297+ |
| 43 - | | batting potential = | .305+ |
| 44 - | | batting potential = | .314+ |
| 45 - | | batting potential = | .322+ |
| 46 - | | batting potential = | .331+ |

NOTE:

the higher the number, the harder the ball was hit, and the further and faster the ball traveled.

The following is a preferred CHART FOR OUTS, as mentioned earlier.

| | |
|---|---|
| 41 - soft rolling infield ground ball outs: | |
| 42 - | 41-46 to pitcher, locators ◇7 & ◇8, |
| 43 - | 47-48 to short, ◇7, and second, ◇8, |
| 44 - | 41-48 ◇6, slow to third, and ◇9, slow to first; |
| 45 - | pitchers can turn double play, check rule, |
| 46 - | all other infielders, ball too slow for a |
| 47 - | double play; batter out, lead runner safe. |
| 48 - | |
| 51 - infield ground ball outs: | |
| 52 - | 51-58 ground ball out to infielder, |
| 53 - | infielder can always get the lead runner |
| 54 - | out; to turn a double play, check rule. |
| 55 - | |
| 56 - | |
| 57 - | challenges DefB |
| 58 - | challenges DefA |

-continued

| | |
|---|---|
| 61 - infield line drive outs: | |
| 62 - | 61-64 line drive outs; batter out, runners hold, |
| 63 - | double play on hit&run. |
| 64 - | |
| 65 - infield pop outs: | |
| 66 - | 65-68 easy pop-ups on the infield, or foul. |
| 67 - | |
| 68 - | |
| 71 - shallow pop fly outs: | |
| 72 - | 71-74 outfielder fields moving in. |
| 73 - | |
| 74 - | |
| 75 - line drive outfield outs: | |
| 76 - | (75-76 line drive outs, outfielder coming in |
| 77 - | (77-78 outfield moving sideways or back |
| 78 - | |
| 81 - fly ball outfield outs: | |
| 82 - | 81-82 outfielder fields drifting back. |
| 83 - | 83-84 outfielder fields running back. |
| 84 - | |
| 85 - deep fly ball outfield outs: | |
| 86 - | 85-86 outfielder fields at the warning track. |
| 87 - | 87 fielder to the wall. challenges DefB. |
| 88 - | 88 fielder up the wall. challenges DefA. |

NOTE:
the higher the number, the harder the ball was hit, and the more challenging the play for the fielder.

History of The Game

I began with two dice, used to create combinations, such that 1×1 was a strikeout, and 6×6 was a home run, etc. This was a start, but it didn't account for any differences between players. It was still more fun, however, than just collecting the cards.

In my search for a better game I discovered "Strat-O-Matic" and "Statis-Pro Baseball." For baseball simulation board games, these were great, but for a baseball card fan they were overly complex, and consisted almost entirely of reading charts; and neither game had anything to do with baseball cards.

I set out to design something just as entertaining, made for baseball cards. I also wanted something that was just as complex in theory and design, but much more simplistic in its functionality. Additionally, I wanted a game based on what a player could do, not what he did do.

After several trial seasons, The Game is absolutely the next big thing for baseball cards. This is something that will bring a whole new level of excitement and purpose to baseball card collecting.

I have polished The Game into something more fun and detailed than 1 had ever intended. I can account now for even the smallest of details such as the altitude at Coors Field, or the wind blowing in or out at Wrigley. The Game is now ready for the public. The Game will rejuvenate baseball card collecting in a monumental way. This is the game the baseball card market is waiting for.

Value of The Game

The Game is a game made for baseball cards, designed as a vehicle to reignite the baseball card market. The Game gives baseball cards the ability to play.

The Game has the potential and ability to revolutionize and revitalize the entire baseball card market. By allowing all baseball cards to now play, there will be a real and exciting reason to buy and collect baseball cards.

The Game gives a baseball card a far bigger purpose. It also gives the baseball card a considerable increase in actual value, because it now has an actual reason for purchasing.

The Game brings a new and thrilling versatility to an enormous, and deflated, market. It has the ability to completely change the dynamics of baseball card collecting.

Simply put, if given the choice between two of the same card, but one played baseball, and one didn't, which card would you choose?

Business for The Game

Baseball simulation board games have enjoyed moderate popularity, as evidenced by the long term success of "Strat-O-Matic," and the emergence of "MLB Showdown." However, "MLB Showdown" is just another board game, played with game cards that are not baseball cards, and "Strat-O-Matic" has nothing to do with baseball cards. The Game is about baseball cards, not about charts and a board. The success of the other baseball games has been in their ability to simulate a detailed and intricate game of baseball. The Game has that same successful framework, but succeeds in many key ways where the others fail. This game will have the market impact and position "Pokemon" and "Magic" both enjoyed. This game is about cards.

The producer of The Game will have the potential for an unprecedented increase in popularity and profits of baseball cards, with little overhead, and a minimal investment of capital. The Game is simply a language (a small number grid) applied to a baseball card, and played using the Playing Deck, which can be manufactured at a negligible cost. The producer simply needs to print the player's potential on the cards, and they are ready to play ball, redefining and monopolizing the baseball card market. There is nothing to lose, and an entire marketplace to gain.

Marketplace for The Game

Baseball cards that play ball will now have a tangible value based on their worth in The Game. For example, a player's card could have increasing value throughout the majority of his career. This is completely opposite of the current marketplace, where only rookie cards and inserts are valuable.

With The Game a player's card gains value as he improves his abilities. This could have enormous ramifications for card collectors, as well as for the producer of The Game. For the first time a baseball card will have actual value rather than just implied value. The Game will create a very real reason to buy and collect baseball cards.

Collectors currently focus only on an elite group of players, and primarily just the rookie cards of those, leading to a market where only a very small percentage of all cards produced have any value at all. The Game gives all baseball cards value. Baseball fans will now have a reason to purchase baseball cards, and collect all the cards made. Baseball card collectors have never had a reason to collect a backup catcher's card, but with The Game, now they do.

Now that every card can play ball, a demand will be created for every player in the majors, as well as players in the minors. Collectors who play will undoubtedly want full rosters of teams. Now that every card is necessary, the producer could produce the entire 40-man roster for each team, at a profit. Furthermore, the producer could produce home and away player cards, having slightly increased and decreased values, depending on the uniform in the picture.

Also, the producer would be able to produce cards that play ball for any baseball player who ever played. Any and all players produced could then play ball on your team. A whole market could be created for cards and players long since seen.

You could see kids battling after school with Sandy Koufax facing Willie Mays, or Satchel Paige staring down Josh Gibson; or Roger Clemens facing Lou Gerhig, or Bob Gibson staring down Barry Bonds. Older cards have recently been remade, but there is no reason to buy them, there is no value for them. With The Game these older cards become extremely fun and valuable.

With The Game the producer will also have the ability to create rare & valuable cards. For example, you could have the normal Derek Jeter card; the rare silver Derek Jeter card that has an extra double number; the even more rare gold Derek Jeter card that has an extra home run number; the ultra rare platinum Derek Jeter card that has the extra home run number and is better defensively; and the rarest diamond Derek Jeter card that has more power, a higher batting average, and is better defensively. In this manner the producer would be able to create incredibly valuable cards to collect.

Also, consider this unique x-factor. The producer could produce a baseball playing card for persons of any walk of life. They could produce The Game cards of anyone from Jeff Gordon to Joe Montana, from Tracy McGrady to Tiger Woods. Imagine, if you will, an "Upper Deck" celebrity softball game. Picture Brett Favre staring down LeBron James, with two outs, Mario Lemieux on third, and Andy Roddick on first thinking about stealing. Or, if you will, imagine Superman facing Batman with the bases loaded and no outs, and Thor on deck. Why not? All you need is a Playing Deck, and The Game printed on the cards.

With The Game for the first time there could be baseball card tournaments, and baseball card leagues, both live, and on-line. Since The Game is simply a language for baseball cards, The Game could also be available on-line, and spur the next realm of virtual baseball card collecting.

In accordance with another aspect of the present invention, the player cards with the game playing indicia on them can be packaged and sold. Thus, a group of player cards with game playing indicia can be sold together in a package.

The game is further described in the attached Appendix A and Appendix B, both of which are incorporated by reference.

The invention claimed is:

1. A card game for simulating a baseball game, comprising:

a first playing deck of at least 54 different cards, each card displaying only two indicia including a first indicia with an associated number in a first range of numbers and a second indicia with an associated number within a second range of numbers, the numbers in the first range of numbers being different from the numbers in the second range of numbers;

a card of a pitcher having a number within the first range of numbers associated with the first indicia on the first playing deck of cards and a display of results from an at bat indicated by a range of numbers that coincides with the second range of numbers associated with the second indicia on the first playing deck of cards; and a second playing deck of cards representing a plurality of baseball players that take turns at bat in the baseball game, each card in the second playing deck having results from an at bat indicated by a range of numbers that coincides with the second range of numbers associated with the second indicia on the first playing deck of cards.

2. The card game of claim 1, further comprising a die to impose an advanced playing rule.

3. The card game of claim 2, wherein the advanced playing rule pertains to a double play.

4. The card game of claim 1, wherein the first range of numbers associated with the first indicia on a card in the first playing deck determines whether to use the card of the pitcher or one of the cards in the second playing deck of cards to determine the outcome for the batter of a hit of a ball.

5. The card game of claim 1, wherein the second range of numbers on the card of the pitcher or on one of the cards in the second playing deck of cards then determines the outcome for a field player of a hit of a ball by the batter.

6. The card game of claim 1, wherein each of the cards in the second playing deck of cards includes a picture of a baseball player and the second range of numbers is related to a past performance by the baseball player.

* * * * *